US008766116B2

(12) United States Patent
Barrena et al.

(10) Patent No.: US 8,766,116 B2
(45) Date of Patent: Jul. 1, 2014

(54) ROTARY ENCODER SUITABLE FOR A USE WITH A GAS VALVE ON A RANGE

(75) Inventors: Juan J. Barrena, Johnston, RI (US); Edward J. Claprood, Jr., West Boylston, MA (US)

(73) Assignee: Illinois Tool Works Inc., Glenview, IL (US)

( * ) Notice: Subject to any disclaimer, the term of this patent is extended or adjusted under 35 U.S.C. 154(b) by 249 days.

(21) Appl. No.: 13/503,300

(22) PCT Filed: Oct. 12, 2010

(86) PCT No.: PCT/US2010/052312

§ 371 (c)(1), (2), (4) Date: Apr. 20, 2012

(87) PCT Pub. No.: WO2011/049785

PCT Pub. Date: Apr. 28, 2011

(65) Prior Publication Data

US 2012/0199113 A1 Aug. 9, 2012

Related U.S. Application Data

(60) Provisional application No. 61/254,084, filed on Oct. 22, 2009.

(51) Int. Cl.
*H01H 9/00* (2006.01)

(52) U.S. Cl.
USPC ..... 200/17 R

(58) Field of Classification Search
USPC ..... 200/17 R, 11 D, 14, 18, 11 DA, 243, 281; 439/68, 76.1; 126/39 BA, 39 E, 1 A; 29/890.02
See application file for complete search history.

(56) References Cited

U.S. PATENT DOCUMENTS

| | | | | |
|---|---|---|---|---|
| 2,841,660 | A | 7/1958 | Tabet | |
| 2,971,066 | A | 2/1961 | Tabet | |
| 3,015,000 | A | 12/1961 | Tabet | |
| 3,111,640 | A | 11/1963 | Dial | |
| 3,211,845 | A | 10/1965 | Zoltai | |
| 5,575,638 | A | 11/1996 | Witham et al. | |
| 5,886,310 | A * | 3/1999 | Kataoka et al. | 200/14 |
| 6,504,731 | B2 * | 1/2003 | Okamoto | 361/826 |
| 7,067,745 | B2 | 6/2006 | Holt | |
| 8,536,472 | B2 * | 9/2013 | Wu et al. | 200/4 |

FOREIGN PATENT DOCUMENTS

EP 1583123 A1 10/2005

OTHER PUBLICATIONS

ISR for PCT/US2010/052312 dated Feb. 10, 2011.

* cited by examiner

*Primary Examiner* — Edwin A. Leon
(74) *Attorney, Agent, or Firm* — Mark W. Croll; Paul F. Donovan

(57) ABSTRACT

A valve stem position sensor for a gas range provides a slotted housing, wiper assembly, and printed circuit board that may be aligned to allow the sensor to be installed on the valve stem from the side of the valve stem rather than over the end of the valve stem permitting the valves to be partially installed in the gas range with the valve stems extending through the console for mechanical support during the remainder of the assembly process.

20 Claims, 2 Drawing Sheets

ROTARY ENCODER SUITABLE FOR A USE WITH A GAS VALVE ON A RANGE

CROSS REFERENCE TO RELATED APPLICATION

This Non-Provisional Application is national phase of PCT/US2010/052312 filed Oct. 12, 2010, and claims benefit to U.S. Provisional Application Ser. No. 61/254,084 filed Oct. 22, 2009 hereby incorporated by reference.

FIELD OF THE INVENTION

The present invention relates to cooking ranges having gas burners and specifically to a rotation sensor for sensing a position of a burner control valve.

BACKGROUND OF THE INVENTION

Gas ranges which cook using the combustion of natural gas or the like are prized by chefs who value their fast response and high heat output. Such gas ranges may use gas valves which meter gas to individual burners according to rotation of the valve stem communicating with an internal valve mechanism. Control of the gas valves by a consumer is provided by rotation of a control knob fitting over an end of the valve stem as it passes through a console on the front of the range. By controlling the volume flow of gas to the burner, the output of the burner may be adjusted. Many modern gas ranges include electronic igniters that may be triggered by initial movement of the valve detected by a sensor switch to automatically ignite the gas at the burner.

Low heat ranges for simmering or the like are not always easily obtained with a gas range because low rates of gas flow are difficult to control to a steady level and/or low gas flow rates do not reliably support a flame. For this reason, high-end gas ranges may employ a strategy for low heat ranges in which heat output is controlled not by adjusting the continuous rate of gas flow but by pulsing the gas flow on and off according to a schedule to control an average treated gas flow producing the desired heat. Electrical igniters ignite the gas at the beginning of each pulse cycle.

This technique of heat control requires a rotational encoder attached to the gas valve to relay its rotational position by an electrical signal to a controller that may effect the desired pulse schedule turning the gas valve on and off and that may appropriately control the igniter. This rotary encoder, for example, may be a potentiometer having a rotating element through which the valve stem is threaded so that the rotating element turns with the valve stem and provides a variable voltage (or resistance) indicating the rotational position of the valve stem.

Assembly or replacement of the rotary encoder on the gas valve can be difficult, requiring installation or removal of the rotary encoder before the valve stem is inserted through a hole in the console and thus before the valve stem is securely positioned to the range. Early installation of the rotary encoder risks damage to the encoder during mechanical assembly of the valves to the manifold and gas piping of the range and prevents pre-assembly of the valves to a frame before they are identified to a particular range feature set.

SUMMARY OF THE INVENTION

The present invention provides a rotary encoder designed to be installed on the stem of a gas valve in a direction perpendicular to the axis of the stem. In this way, the rotary encoder may be slipped onto the valve stem "sideways" eliminating the need to have access to the end of the valve stem. In this way the present invention improves manufacturability of the range by permitting partial assembly of the console before the installation of the rotary encoders. The invention further permits improved field repair by eliminating the need for complete disassembly of the console for the replacing of one encoder.

Specifically, the present invention provides a rotary encoder for use with a gas valve on a range, the gas valve having a valve stem. The rotary encoder includes a housing having a slot extending from one edge of the housing to a central portion so that the housing may be installed around the valve stem along an axis perpendicular to an axis of rotation of the valve stem, the housing sized to fit between a valve body and a control knob attachable on an end of the valve stem. A printed circuit board fits within the housing and has a corresponding slot aligned with the slot of the housing and has electrical conductors on at least a first surface. A wiper assembly fits within the housing against the first surface of the printed circuit board to contact the electrical conductors on the first surface with rotation of the wiper assembly. The wiper assembly further has a slot corresponding to the slot of the housing and the slot of the printed circuit board and aligned therewith at a predetermined rotational orientation.

It is thus a feature of at least one embodiment of the invention to provide a rotary encoder that may be installed or removed while the valves are partially or fully assembled to the range.

The valve stem may provide a key surface received by a corresponding key surface at the end of the slot of the wiper assembly to cause the valve stem and wiper assembly to rotate together when the wiper assembly is installed on the valve stem. In one example, the key surface may be a flat on the valve stem and corresponding flat on the end of the slot of the wiper assembly aligned generally with one wall of the slot of the wiper assembly.

It is thus a feature of at least one embodiment of the invention to provide an interlocking between the valve stem and the wiper assembly that may accommodate installation of the valve assembly through a slot.

The slot in the wiper assembly may be substantially a width of the valve stem.

It is thus a feature of at least one embodiment of the invention to maximize the available angular surface of the printed circuit board for rotary encoding.

An end of the slot in the wiper assembly may provide a partial collar extending along the axis of the valve stem to partially surround the valve stem.

It is thus a feature of at least one embodiment of the invention to offset the decrease contact surface of the slot of the wiper assembly with the valve stem through an augmenting collar.

The wiper assembly may have a substantially circular outer periphery received by corresponding arcuate guides in the housing so that the wiper assembly is constrained to rotate with respect to the housing about a center point aligned with the end of the slot of the housing and the wiper assembly.

It is thus a feature of at least one embodiment of the invention to preserve rotational alignment of the components of the rotary encoder before they are installed on the valve stem.

The wiper assembly and housing may include stop surfaces limiting rotation of the wiper assembly with respect to the housing.

It is thus a feature of at least one embodiment of the invention to prevent damage to the wiper arms before or during installation.

The wipers may connect to a resistive ladder on the printed circuit board to provide a variable resistance with rotation of the valve stem.

It is thus a feature of at least one embodiment of the invention to provide a simple electrical interface standard relying on voltages or resistances.

The housing may include alignment pins engaging with corresponding bores of the valve stem when the housing is moved along the axis of rotation of the valve stem. At least one alignment pin may include a resilient barb for releasably retaining the alignment pin within a corresponding bore of the valve stem.

It is thus a feature of at least one embodiment of the invention to permit the housing to be simply attached to the valve by axial motion without the need for separate connectors or the access space for installing those connectors.

The housing may include at least one alignment surface engaging outer surfaces of the valve stem when the housing is moved along the axis of rotation of the valve stem.

It is thus a feature of at least one embodiment of the invention to provide an increased resistance to rotational torque between the valve and the housing beyond that which may be provided by pre-existing valve bores.

The housing may further include a releasable electrical connector half receiving a corresponding connector along an engagement axis generally parallel to the rotational axis of the valve stem. The electrical connector may receive the corresponding electrical connector from a side of the housing removed from a side of the housing closest to the control knob when installed on the valve stem.

It is thus a feature of at least one embodiment of the invention to permit ready electrical connection of the rotary encoder after installation on the valve.

Generally, the present invention enables a method of manufacturing a gas range comprising the steps of installing a valve manifold providing a gas pipe and a least one gas valve to a portion of the range behind a console so that valve stems of the gas valve extend through apertures within the console and then sliding a valve stem rotational sensor as described above onto the valve stems behind the console along an axis substantially perpendicular to an axis of rotation of the valve stem.

It is thus a feature of at least one embodiment of the invention to substantially simplify manufacture and repair of a gas range.

Other features and advantages of the invention will become apparent to those skilled in the art upon review of the following detailed description, claims and drawings in which like numerals are used to designate like features.

Figure 1:
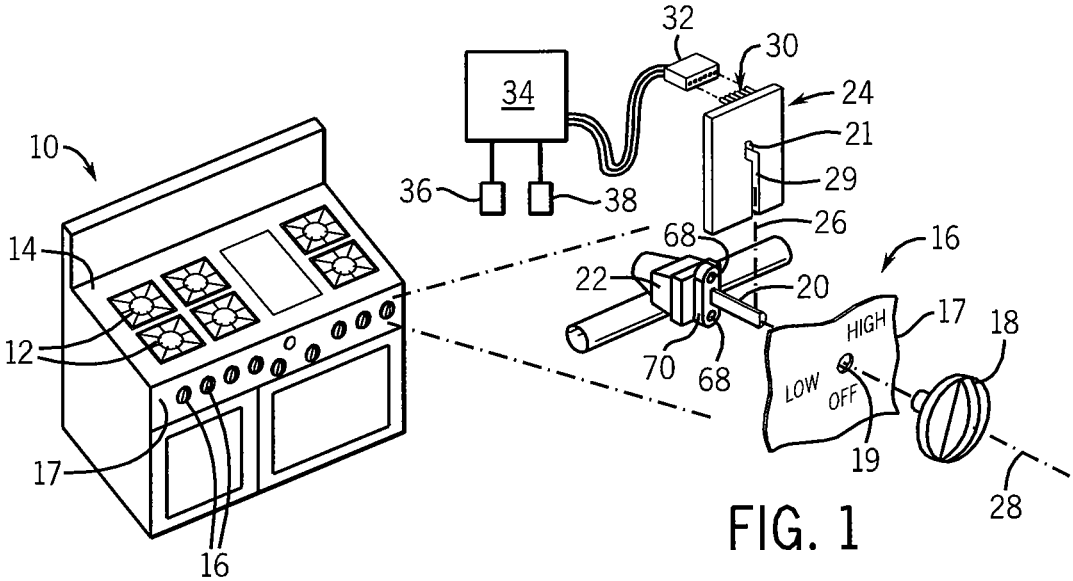
FIG. 1 is a perspective view of a gas range having multiple controls showing an exploded view of one such control and a sideways mounting of a rotary encoder on a valve stem of the valve associated with the control.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof are meant to encompass the items listed thereafter and equivalents thereof as well as additional items and equivalents thereof.

DETAILED DESCRIPTION OF THE PREFERRED EMBODIMENT

Referring now to FIG. 1, a gas range 10 may include one or more burners 12 exposed at an upper cooking surface 14 of the gas range 10. Gas to the burners 12 may be controlled by means of associated controls 16 accessible to a user at a front console 17. Each of the controls 16 may provide a knob 18 of conventional design having indicia indicating a setting of the control 16, for example, in a range from "off" to "high" and including a "low heat" range.

A knob 18 may be attached to a valve stem 20 passing through an aperture 19 in the front console 17, the valve stem 20 connected with a gas valve 22 behind the front console 17. The front console 17 may be, for example, a plate of enameled steel or the like.

Generally, rotation of the knob 18 and the valve stem 20 controls a flow of gas through the gas valve 22 to a burner 12 over a range that corresponds to the range of "off" to "high". In the "low heat" range. The gas valve 22 may provide both a range of constant flow rates dictated by the angle of the valve stem 20 and electrically control the gas flame on and off as will be described.

In the present invention, a rotary encoder potentiometer 24 is attached to the valve stem 20 to measure rotation of the valve stem 20. The rotary encoder potentiometer 24 may be installed on the valve stem by movement of the rotary encoder potentiometer 24 along an installation axis 26 generally perpendicular to an axis 28 about which the valve stem 20 rotates. For this purpose, the rotary encoder potentiometer 24 may include a slot 29 generally aligned with the installation axis 26 allowing a passage for the valve stem 20 so that the valve stem 20 may move from an edge of the rotary encoder potentiometer 24 to an assembled position at centerpoint 21 roughly centered within the rotary encoder potentiometer 24.

An electrical connector 30 on the rear of the rotary encoder potentiometer 24 may mate with a corresponding connector 32 communicating with a control board 34 providing for electronic circuitry that may read signals from the rotary encoder potentiometer 24 to deduce the rotational orientation of the valve stem 20. The control board 34 may execute a control program based on this rotational orientation to control an igniter 36 associated with a burner 12 controlled by the control 16 and a solenoid valve 38 also associated with the burner 12 controlled by the control 16. The solenoid valve 38 may, for example, be incorporated into the gas valve 22 according to techniques well known in the art. The solenoid valve 38 is actuated when the control 16 is in the "low heat" range to provide for pulsed operation having periods when the burner flame is on and periods when the burner flame is off The pulsing may change in its duty cycle to control average heat without decreasing gas flow beneath a tractable amount.

Figure 2A:
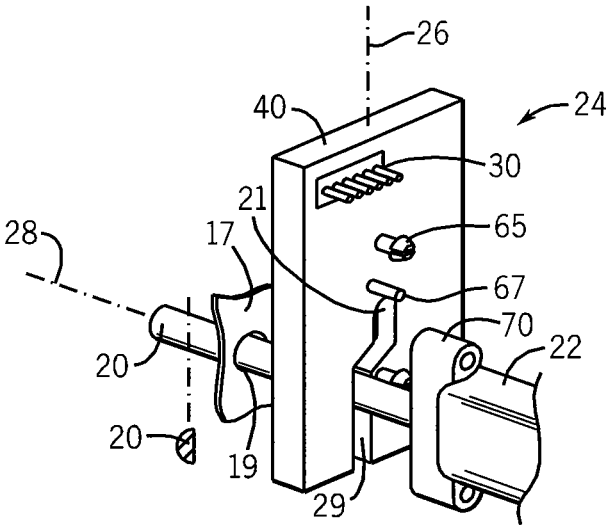
FIGS. 2*a*-2*c* are a sequence of perspective views of the rotary encoder being installed on the stem of the valve.

Referring now to FIG. 2*a*, the rotary encoder potentiometer 24 may provide a generally rectangular housing 40 having a narrow thickness measured along an axis 28 of the valve stem 20 so as to fit easily between a flange 70 of the valve 22 and the console 17 through which the valve stem 20 passes by means of an aperture 19. The housing 40 may be placed above the valve stem 20 behind the console 17 with the valve stem 20 aligned with the opening of the slot 29 in a lower edge of the housing 40.

Figure 2B:
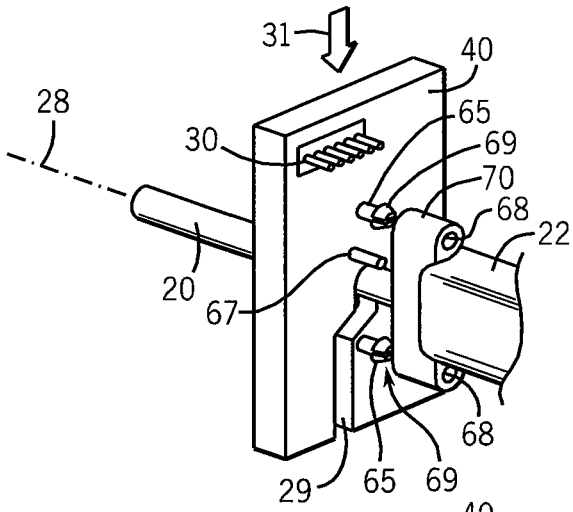

As shown in FIG. 2*b*, the housing 40 may then be moved downward as indicated by arrows 31 along the installation axis 26 in a direction generally perpendicular to axis 28 until the valve stem 20 is aligned with the centerpoint 21 at the center of the housing 40.

Referring to FIGS. 2*a* and 2*b*, extending from a face of the housing 40 toward the valve 22 above and below the centerpoint 21 are attachment pins 65 and alignment pin 67. The attachment pins 65 are displaced vertically above and below the centerpoint 21 to be generally aligned with bores 68 in the flange 70 of the gas valve 22 when the valve stem 20 is at the centerpoint 21.

Figure 2C:
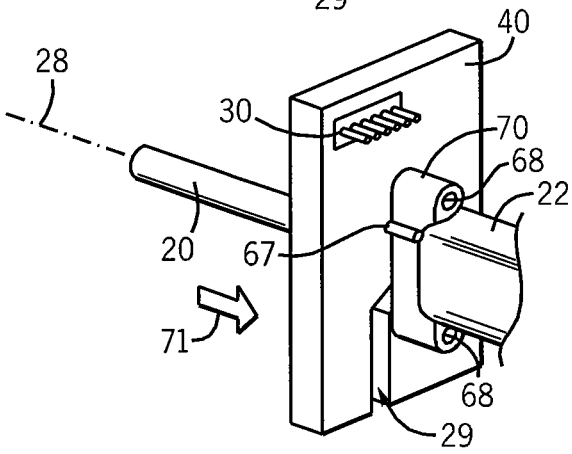

Referring now to FIG. 2*c*, with the valve stem 20 positioned at the centerpoint 21, axial movement as indicated by arrow 71 engages the attachment pins 65 with the bores 68 to lock the valve 22 and the housing 40 together against torsion about axis 28. The attachment pins 65 may include end barbs 69 which may protrude through the bores 68 to expand on the opposite side of the flange 70 to lock the housing 40 against the flange 70 with respect to axial forces along axis 28. Alignment pin 67 slides against one side of the flange 70 to provide further resistance against torsion.

The slot 29 may have a dogleg path, that is a path having a diagonal portion between two generally parallel vertical portions allowing the slot 29 to avoid the lower attachment pin 65.

Figure 3:
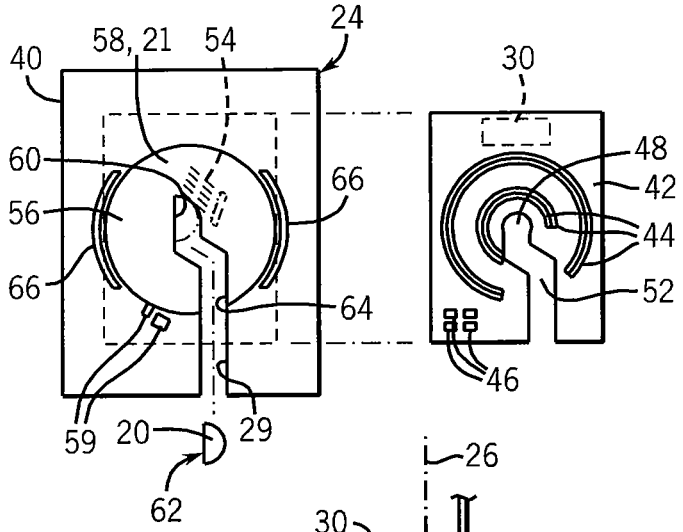
FIG. 3 is a front elevational view in partial exploded form showing a wiper assembly and printed circuit board of the rotary encoder of FIG. 1 within a housing, both having corresponding slots for sideways assembly.

Referring now to FIG. 3, the housing 40 may enclose a printed circuit board 42 mounted to be stationary with respect to the housing 40. The printed circuit board 42 may support on its rear surface the electrical connector 30 which may communicate via traces on the printed circuit board 42 with one or more ring-shaped electrical traces 44 on a front surface of the printed circuit board 42 and, in a preferred embodiment, discrete resistors 46. The ring-shaped traces 44 are concentric about the centerpoint 21 through which the valve stem 20 will pass when the rotary encoder potentiometer 24 is assembled to the valve 22 as described. A central aperture 48 at the centerpoint 21 joins to a generally radially extending slot 52 identical to slot 29 which then passes downward to a lower edge of the printed circuit board 42 cutting through the ring-shaped traces 44. When the printed circuit board 42 is assembled to the housing 40, the slots 29 and 52 are perfectly aligned.

A circular rotary wiper assembly 56 may fit in the housing against the front surface of the printed circuit board 42. The ring-shaped traces 44 of the printed circuit board 42 may be selectively interconnected by wiper springs 54 flexibly extending rearward from the rotary wiper assembly 56 with rotation of the rotary wiper assembly 56. The wiper assembly 56 has a central aperture 58 which is keyed by a flat 60 to conform with a similar keying flat 62 on the valve stem 20 shown displaced from the centerpoint 21 for clarity. A slot 64 passes from an edge of the wiper assembly 56 to join to aperture 58, the slot 64 conforming in shape to the slot 52 of the printed circuit board 42 and a slot 29 of the housing 40 when the rotary wiper assembly 56 is properly aligned for assembly. In this position, the valve stem 20 may pass through the slots 29, 52 and 64 to be received by the aperture 58 in the rotary wiper assembly 56. As so received, rotation of the valve stem 20 will provide identical rotation of the wiper assembly 56 as a result of an interfacing between the key surfaces 62 and 60. A technique for manufacture of an adjustable resistor array suitable for this purpose is described in U.S. application Ser. No. 12/133,731 entitled: "Dial Control With LED Light Ring" filed Jun. 5, 2008 and now published as U.S. Application 2009/0080176, assigned to the assignee of the present invention and hereby incorporated by reference.

The housing 40 may include guides 66 that constrain the wiper assembly 56 to rotate in alignment with the printed circuit board 42 so that apertures 48 and 58 are concentric at the centerpoint 21. A stop 59 may be formed in one or both of the housing 40 and wiper assembly 56 to limit rotational travel of the two. It will be understood that with rotation of the wiper assembly 56, various interconnections may be made between the traces of 44 in the manner of a rotary switch. These interconnections may connect various resistors 46 attached to the traces 44 to provide an effective variable resistor having a resistance value, or a voltage divider value, producing a voltage value functionally related to the rotational position of the valve stem 20. This signal may be provided through the connector 30 to the control board 34.

Figure 4:
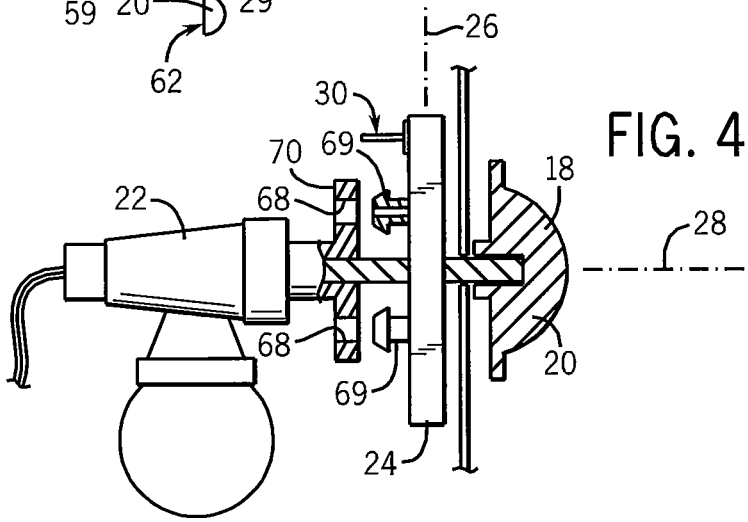
FIG. 4 is a cross-sectional view through the control of FIG. 1 as assembled showing the two steps of sliding the rotary encoder into place and then locking it to the valve without full disassembly of the control console.

Referring now to FIG. 4, as described above, after the rotary encoder potentiometer 24 is installed on the valve stem 20 along an axis 26 with the slots 64 and 52 aligned as shown in FIG. 2*a*, rotary encoder potentiometer 24 may be moved rearward so that rearwardly extending retention barbs 69 are received in corresponding open ended bores 68 of a flange 70 of the gas valve 22. The barbs 69 are passed through the bores 68 to snap in place and thereby retain the housing 40 against rotation about axis 28 or displacement along axis 28. Removal of the rotary encoder potentiometer 24 for servicing or the like may be obtained by simply prying the housing 40 of the rotary encoder potentiometer 24 away from the flange 70 and removing the potentiometer along axis 26.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A rotary encoder for use with a gas valve on a range, the gas valve having a valve stem, the rotary encoder comprising:

a housing having a slot extending from one edge of the housing to a central portion so that the housing may be installed around the valve stem along an axis perpendicular to an axis of rotation of the valve stem, the housing sized to fit between a valve body and a control knob attachable on an end of the valve stem;

a printed circuit board fitting within the housing and having a corresponding slot aligned with the slot of the housing, the printed circuit board having electrical conductors on at least a first surface; and a wiper assembly fitting within the housing against the first surface of the printed circuit board to contact the electrical conductors on the first surface with rotation of the wiper assembly, the wiper assembly further having a slot corresponding to the slot of the housing and the slot of the printed circuit board and aligned therewith at a predetermined rotational orientation wherein in the valve stem provides a key surface received by a corresponding key surface at the end of the slot of the wiper assembly to cause the valve stem and wiper assembly to rotate together when the wiper assembly is installed on the valve stem.

2. The rotary encoder of claim 1 wherein the key surface is a flat on the valve stem and a corresponding flat on the end of the slot of the wiper assembly aligned generally with one wall of the slot of the wiper assembly.

3. The rotary encoder of claim 1 wherein the slot in the wiper assembly is substantially a width of the valve stem.

4. The rotary encoder of claim 3 wherein an end of the slot in the wiper assembly provides a partial collar extending along the axis of the valve stem to partially surround the valve stem.

5. The rotary encoder of claim 1 wherein the wiper assembly has a substantially circular outer periphery received by corresponding arcuate guides in the housing so that the wiper assembly is constrained to rotate with respect to the housing about a center point aligned with the end of the slot of the housing and the wiper assembly.

6. The rotary encoder of claim 5 wherein the wiper assembly and housing includes stop surfaces limiting rotation of the wiper assembly with respect to the housing.

7. The rotary encoder of claim 1 wherein the wipers connect to a resistive ladder on the printed circuit board to provide a variable resistance with rotation of the valve stem.

8. The rotary encoder of claim 1 wherein the housing includes pins engaging with corresponding bores of the valve stem when the housing is moved along the axis of rotation of the valve stem.

9. The rotary encoder of claim 8 wherein the housing includes at least one alignment surface engaging outer surfaces of the valve stem when the housing is moved along the axis of rotation of the valve stem.

10. The rotary encoder of claim 8 wherein the pins include resilient barbs for releasably retaining the pins within a corresponding bore of the valve stem.

11. The rotary encoder of claim 1 wherein the housing further includes a releasable electrical connector half receiving a corresponding connector along an engagement axis generally parallel to a rotational axis of the valve stem.

12. The rotary encoder of claim 11 wherein the electrical connector receives a corresponding electrical connector from a side of the housing removed from a side of the housing closest to the control knob when installed on the valve stem.

13. The rotary encoder of claim 1 wherein the slot in the wiper assembly includes a dogleg.

14. The rotary encoder of claim 1 wherein the valve stem extends to a gas valve controlling the flow of gas therethrough.

15. The rotary encoder of claim 1 wherein the electrical connectors communicate with a solenoid valve controlling an igniter for a burner.

16. The rotary encoder of claim 1 wherein the housing has an interior cavity enclosing the printed circuit board and wiper assembly.

17. The rotary encoder of claim 1 wherein the housing is defined by a top wall, a bottom wall, and a plurality of sidewalls defining a volume.

18. A method of manufacturing a gas range comprising the steps of:

(a) installing a valve manifold providing a gas pipe and at least one gas valve to a portion of the gas range behind a console so that valve stems of the gas valve extend through apertures within the console;

(b) sliding a valve stem rotational sensor onto the valve stems behind the console along an axis substantially perpendicular to an axis of rotation of the valve stems, the valve stem rotation sensors including:

a housing having a slot extending from one edge of the housing to a central portion so that the housing may be installed around the valve stem along an axis perpendicular to an axis of rotation of the valve stem, the housing sized to fit between a valve body and a control knob attachable on an end of the valve stem;

a printed circuit board fitting within the housing and having a corresponding slot aligned with the slot of the housing, the printed circuit board having electrical conductors on at least a first surface; and a wiper assembly fitting within the housing against the first surface of the printed circuit board to contact the electrical conductors on the first surface with rotation of the wiper assembly, the wiper assembly further having a slot corresponding to the slot of the housing and the slot of the printed circuit board and aligned therewith at a predetermined rotational orientation.

19. The method of claim 18 wherein the housing includes alignment pins engaging with corresponding bores of the valve stem when the housing is moved along the axis of rotation of the valve stem end including the step of:

(c) after step (b), sliding the housing axial away to engage alignment pins with the corresponding bores in the valve stem.

20. The method of claim 19 wherein the housing further includes a releasable electrical connector half receiving a corresponding connector along an engagement axis generally parallel to a rotational axis of the valve stem; and wherein the electrical connector receives the corresponding electrical connector from a side of the housing removed from a side of the housing closest to the control knob when installed on the valve stem; and including the step of (d) after step (c) of engaging the electrical connector with the corresponding electrical connector.

* * * * *